US010260747B2

(12) United States Patent
Suzuki et al.

(10) Patent No.: US 10,260,747 B2
(45) Date of Patent: Apr. 16, 2019

(54) COMBUSTION CONTROLLING DEVICE

(71) Applicant: Azbil Corporation, Tokyo (JP)

(72) Inventors: Kayo Suzuki, Tokyo (JP); Takeshi Nishiyama, Tokyo (JP); Shigeki Ishii, Tokyo (JP)

(73) Assignee: Azbil Corporation, Tokyo (JP)

( * ) Notice: Subject to any disclaimer, the term of this patent is extended or adjusted under 35 U.S.C. 154(b) by 54 days.

(21) Appl. No.: 15/470,307

(22) Filed: Mar. 27, 2017

(65) Prior Publication Data

US 2017/0276352 A1 Sep. 28, 2017

(30) Foreign Application Priority Data

Mar. 28, 2016 (JP) ..... 2016-063540

(51) Int. Cl.
*F23N 5/00* (2006.01)
*F23N 5/20* (2006.01)
*F23N 5/24* (2006.01)

(52) U.S. Cl.
CPC ..... *F23N 5/203* (2013.01); *F23N 5/242* (2013.01)

(58) Field of Classification Search
CPC ..... F23N 5/203; F23N 5/242
USPC ..... 431/17–18, 13–15, 69–71
See application file for complete search history.

(56) References Cited

U.S. PATENT DOCUMENTS 5,655,900 A * 8/1997 Cacciatore ..... F23N 5/00 431/29
2012/0208132 A1* 8/2012 Anderson ..... F23D 11/001 431/6

FOREIGN PATENT DOCUMENTS

JP S61019331 Y2 6/1986
JP 2011-208921 A 10/2011
JP 2011-215960 A 10/2011

* cited by examiner

*Primary Examiner* — Vivek K Shirsat
(74) *Attorney, Agent, or Firm* — Oblon, McClelland, Maier & Neustadt, L.L.P.

(57) ABSTRACT

A first reset switch is attached to a combustion controlling device. A second reset switch is installed at a remote place distant from the combustion controlling device. A first reset input from the first reset switch is received without any restriction to release the lockout. A reset input from the second reset switch is received with any restriction to release the lockout. Specifically, when the lockout releases are performed for a predetermined number of times or more upon receiving the reset input before a predetermined time elapses after the lockout has been released upon receiving the initial reset input, the release of the lockout upon receiving the reset input is prohibited until the predetermined time elapses.

3 Claims, 8 Drawing Sheets

COMBUSTION CONTROLLING DEVICE

CROSS-REFERENCE TO RELATED APPLICATION

This application claims priority to Japanese Application No. 2016-063540 filed on Mar. 28, 2016. This application is incorporated herein in its entirety.

TECHNICAL FIELD

The present invention relates to a combustion controlling device that controls the operation of a combustion device.

BACKGROUND

FIG. 6 illustrates an example of a combustion system using a combustion controlling device that controls the operation of a combustion device (see, for example, Japanese Unexamined Patent Application Publication No. 2011-208921). A combustion system 100 includes combustion equipment 1, a combustion controlling device 2 (2B), a fuel flow channel 3, and an air flow channel 4.

The combustion equipment 1 includes a combustion chamber 5, a main burner 6 for heating an interior of the combustion chamber 5, a pilot burner 7 for igniting the main burner 6, an ignition device (IG) 8 for igniting the pilot burner 7, a flame detector 9 for detecting a flame intensity of the burner (the pilot burner 7 and the main burner 6), and a temperature sensor 10 for detecting a temperature in the combustion chamber 5.

The fuel flow channel 3 is a flow channel for supplying a fuel to the combustion equipment 1 and includes a main flow channel 3*a* to which the fuel is supplied from an outside, a first flow channel 3*b* and a second flow channel 3*c* which branch from the main flow channel 3*a*. The first flow channel 3*b* is connected to the main burner 6 and the second flow channel 3*c* is connected to the pilot burner 7. A gas pressure switch 15 is disposed in the main flow channel 3*a*, safety shutoff valves 11 and 12 are disposed in the first flow channel 3*b*, and safety shutoff valves 13 and 14 are disposed in the second flow channel 3*c*.

One end of the air flow channel 4 is connected to a blower 16 and the other end of the air flow channel 4 is connected to the first flow channel 3*b*. An air discharged from the blower 16 is supplied to the main burner 6 through the first flow channel 3*b* together with a fuel (gas). A wind pressure switch (air flow switch) 17 and a damper 18 are installed in the air flow channel 4.

The combustion controlling device 2 (2B) receives a flame detection signal (a signal indicative of a flame intensity of the burner) from the flame detector 9 and a temperature detection signal from the temperature sensor 10, and outputs control signals to the safety shutoff valves 11 to 14, and the ignition device 8, the blower 16, the damper 18 and the like. As a result, the operation of a combustion device 19 whose components are enclosed by a one-dot chain line in the drawing is controlled according to the control signals.

Depending on the type of the combustion device 19, there are a type of eliminating the flame of the pilot burner 7 after ignition of the main burner 6, a type of continuing the flame of the pilot burner 7 even after the ignition of the main burner 6, and so on. In the former type, the flame detector 9 first detects the flame intensity of the pilot burner 7 and then detects the flame intensity of the main burner 6. In the latter type, the flame detector 9 detects the flame intensity of the pilot burner 7 and the main burner 6 together. There is also a type in which the pilot burner 7 is not provided and only the main burner 6 is provided. In the present specification, both of the pilot burner 7 and the main burner 6 are called burners, and the flame detected by the flame detector 9 is called a flame of the burner. FIG. 6 illustrates a type in which the flame of the pilot burner 7 is kept even after the ignition of the main burner 6, and the flame detector 9 detects the flames of the pilot burner 7 and the main burner 6 as the flames of the burners.

Further, the combustion controlling device 2 (2B) monitors the states of the gas pressure switch 15, the wind pressure switch 17, the flame detector 9 and the like, closes the safety shutoff valves 11 to 14 when detecting an abnormality, blocks the supply of the fuel to the burners, and enters a lockout state (see, for example, Japanese Utility Model Registration No. 61-19331).

In the combustion system 100, when the combustion controlling device 2 (2B) enters the lockout state, the lockout state cannot be released by turning on a power again or the like, and the operation of a reset switch is required (see, for example, Japanese Unexamined Patent Application Publication No. 2011-215960).

In the combustion system 100, a reset method A or a reset method B described below is employed as a method of operating the reset switch (reset operation).

[Reset Method A]

No restriction is imposed on the reset operation, and the reset operation is set to be enabled.

[Reset Method B]

After the reset operation has been performed, the reset operation is disabled for a certain time.

SUMMARY

However, in the reset method A described above, an installation location of the reset switch is restricted. That is, the reset switch needs to be installed in the vicinity of the combustion device so that a service person or the like can perform the reset operation while confirming the safety of the combustion device. For example, as illustrated in FIG. 7, a reset switch SWA is attached to the combustion controlling device 2 (2B).

Further, the above-described reset method B is an advantageous method in the case where because the reset operation is restricted, an erroneous operation is prevented and the lockout state of the combustion device is released from a remote place in which the combustion device is not seen, and the installation location of the reset switch is not restricted.

In other words, as illustrated in FIG. 8A, the reset switch SWB may be attached to the combustion controlling device 2 (2B). As illustrated in FIG. 8B, the reset switch SWB may be installed at a remote place separated from the combustion controlling device (2B).

However, in the reset method B, combustion and accidental fire (non-ignition/flame failure) may be repeated many times in a short time due to heavy use of the reset switch without confirming the safety of the combustion device, and unburned gas may be accumulated in the combustion chamber and the safety may be impaired.

The present invention has been made in order to solve the above problems, and it is an object of the present invention to provide a combustion controlling device which is capable of releasing a lockout state of a combustion device even from a remote place or a nearby place, and capable of preventing frequent use of a reset switch for a short time from the remote place.

In order to achieve the above object, an example of the present invention provides a combustion controlling device (2A) for controlling the operation of a combustion device (19), having a lockout portion (2-1) that detects an abnormality of the combustion device (19) to put the combustion controlling device (2A) into a lockout state; a first reset switch (SW1) that is attached to the combustion controlling device (2A); a second reset switch (SW2) that is provided at a remote place distant from the combustion controlling device (2A); a first lockout releasing portion (2-2) that receives a first reset input (RS1) indicative of an operation restart of the combustion device (19) from the first reset switch (SW1) without any restriction to release the lockout state of the combustion controlling device (2A); and a second lockout releasing portion (2-3) that receives a second reset input (RS2) indicative of the operation restart of the combustion device (19) from the second reset switch (SW2) with any restriction to release the lockout state of the combustion controlling device (2A), wherein when the second lockout releasing portion (2-3) releases the lockout state of the combustion controlling device (2A) upon receiving the second reset input (RS2) by a predetermined number of times (N) or more before a predetermined time (T) elapses after the second lockout releasing portion (2-3) receives an initial second reset input (RS2) and releases the lockout state of the combustion controlling device (2A), the second lockout releasing portion (2-3) prohibits the release of the lockout state of the combustion controlling device (2A) upon receiving the second reset input (RS2) until the predetermined time (T) elapses.

In the present invention, the first reset switch (SW1) is attached to the combustion controlling device (2A), and the second reset switch (SW2) is installed at a remote place distant from the combustion controlling device (2A). The first lockout releasing portion (2-2) indefinitely receives the first reset input (RS 1) indicative of the operation restart of the combustion device (19) from the first reset switch (SW1) to release the lockout state of the combustion controlling device (2A), and the second lockout releasing portion (2-3) receives the second reset input (RS2) indicative of the operation restart of the combustion device (19) from the second reset switch (SW2) with any restriction to release the lockout state of the combustion controlling device (2A).

In the present invention, the release of the lockout state of the combustion controlling device (2A) upon receiving the second reset input (RS2) in the second lockout releasing portion (2-3) with any restriction is performed as follows. In other words, the reset operation is not disabled for a certain time as in the conventional reset method B, but when the release of the lockout state of the combustion controlling device (2A) upon receiving the second reset input (RS2) is performed by the predetermined number of times (N) or more before the predetermined time (T) elapses after the lockout state of the combustion controlling device (2A) has been released upon receiving the initial second reset input (RS2), the release of the lockout state of the combustion controlling device (2A) upon receiving the second reset input (RS2) is prohibited until the predetermined time (T) elapses.

As a result, in the present invention, the release of the lockout state of the combustion controlling device (2A) upon receiving the second reset input (RS2) is permitted within the limit of the predetermined number of times (N) (for example, five times) before the predetermined time (T) (for example, 15 minutes) elapses after the lockout state of the combustion controlling device (2A) has been released upon receiving the initial second reset input (RS2). The lockout state of the combustion controlling device (2A) can be released from a remote place and a nearby place, and frequent use of the reset switch (SW 2) from the remote place for a short time can be prevented.

In the above description, the components in the drawings corresponding to components of the invention are indicated by reference numerals enclosed in parentheses.

According to the present invention, the first reset switch is attached to the combustion controlling device, the second reset switch is installed at the remote location distant from the combustion controlling device, and the lockout state of the combustion controlling device is released upon receiving the first reset input from the first reset switch without any restriction. On the other hand, when the release of the lockout state of the combustion controlling device upon receiving the second reset input is performed by the predetermined number of times or more before the predetermined time elapses after the lockout state of the combustion controlling device has been released upon receiving the initial second reset input from the second reset switch, the release of the lockout state of the combustion controlling device upon receiving the second reset input is prohibited until the predetermined time elapses. As a result, the lockout state of the combustion controlling device can be released from the remote place and the nearby place, and the frequent use of the reset switch from the remote place for the short time can be prevented.

DETAILED DESCRIPTION

Figure 1:
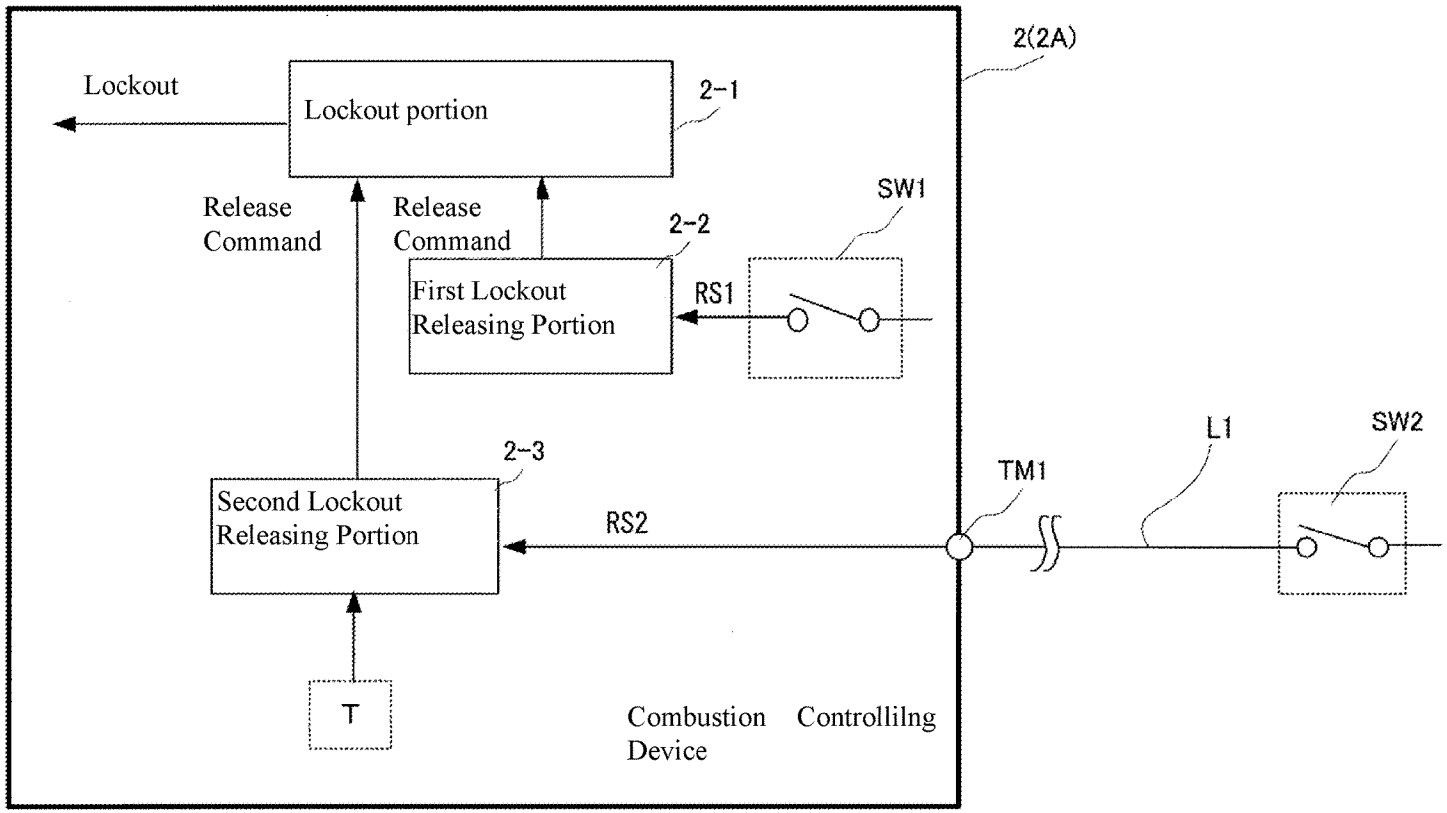
FIG. 1 illustrates a main portion of a combustion controlling device according to an example of the invention.

An example of the invention will be described in detail below with reference to the drawings. FIG. 1 is a diagram illustrating a main portion of a combustion controlling device 2 (2A) according to an example of the present invention.

Figure 6:
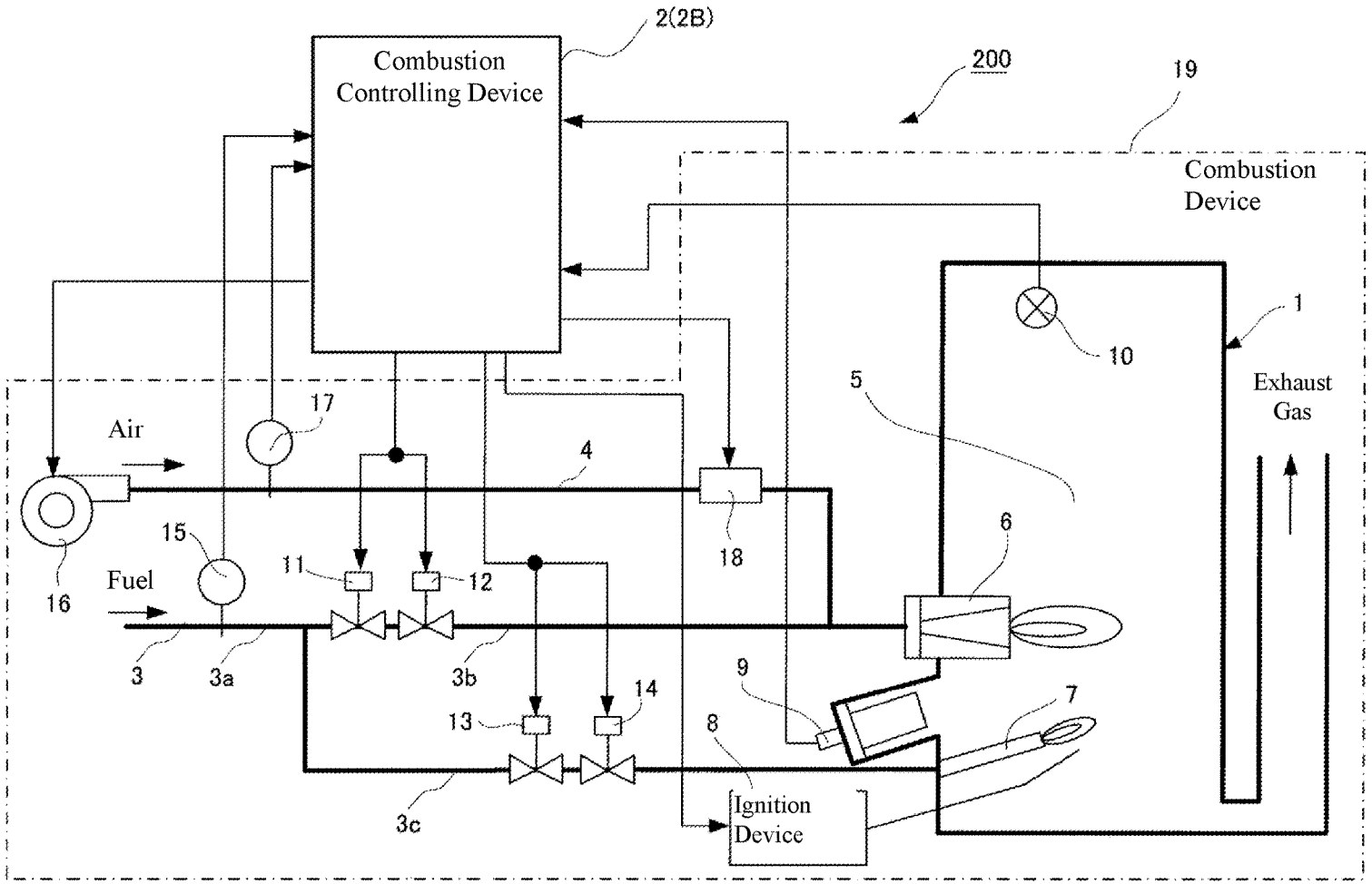
FIG. 6 is a diagram illustrating an example of a combustion system with the use of the combustion controlling device for controlling the operation of a combustion device.
Figure 7:
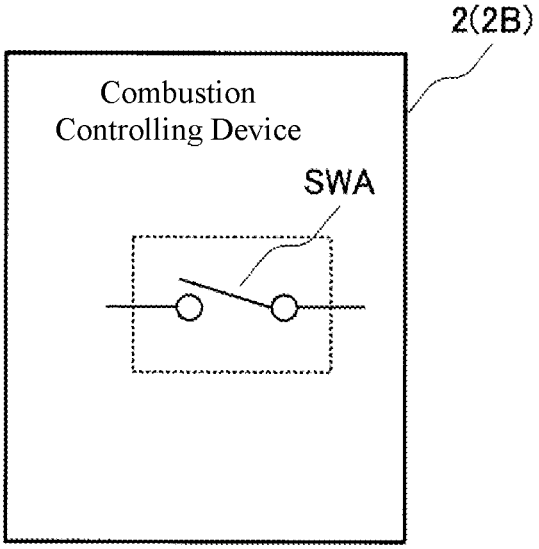
FIG. 7 is a diagram illustrating an example of attachment of a reset switch in the case of a reset method A.
Figure 8A:
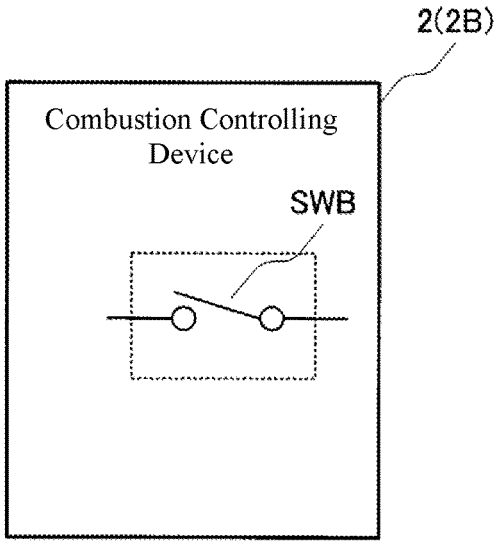
FIG. 8A is a diagram illustrating an example in which the reset switch is attached to the combustion controlling device in the case of a reset method B.
Figure 8B:
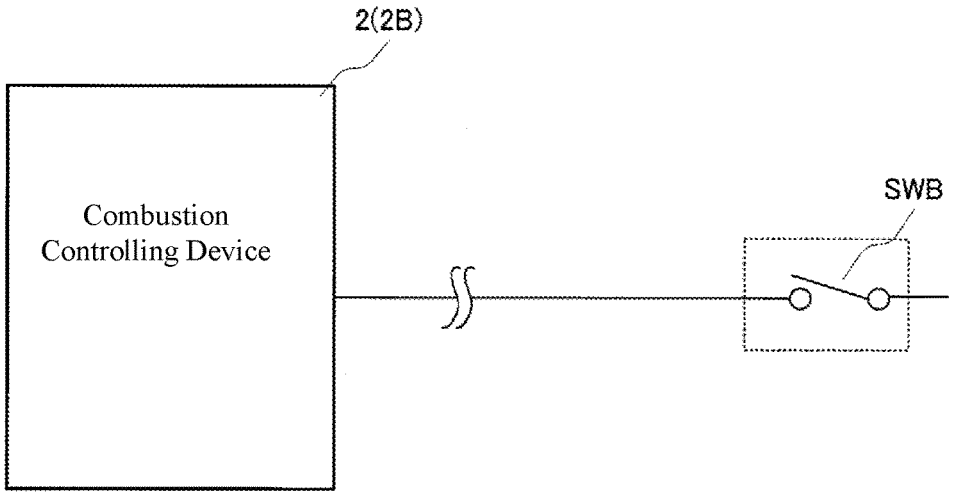
FIG. 8B is a diagram illustrating an example in which the reset switch is installed at a remote place distant from the combustion controlling device in the case of the reset method B.

The combustion controlling device 2 (2A) is configured by hardware including a processor and a memory device and a program achieving various types of functions in cooperation with the hardware. The functions of the combustion controlling device 2 (2A) and the conventional combustion controlling device 2 (2B) illustrated in FIG. 6 are partly different from each other.

FIG. 1 illustrates only functional portions of the combustion controlling device 2 (2A) which are noteworthy in the present example. In addition, a basic configuration of a combustion device whose operation is controlled by the combustion controlling device (2A) refers to the configuration of the combustion device 19 illustrated in FIG. 6.

The combustion controlling device 2 (2A) is provided with a first reset switch SW 1 and a second reset switch SW 2 as reset switches. The first reset switch SW 1 is attached to the combustion controlling device 2 (2A). The second reset switch SW2 is connected to an external inputting portion TM1 of the combustion controlling device 2 (2A) through an electric wire L1 and is installed at a remote place distant from the combustion controlling device 2 (2A).

As noteworthy functional portions in the present example, the combustion controlling device 2 (2A) is provided with a lockout portion 2-1 for detecting abnormality of a combustion device 19 to set the combustion controlling device 2 (2A) in a lockout state, a first lockout releasing portion 2-2 that receives a first reset input RS1 indicative of an operation restart of the combustion device 19 from the first reset switch SW1 without any restriction to release the lockout state of the combustion controlling device 2 (2A), and a second lockout releasing portion 2-3 that receives a second reset input RS2 indicative of the operation restart of the combustion device 19 from the second reset switch SW2 with any restriction to release the lockout state of the combustion controlling device 2 (2A).

Meanwhile, the first reset switch SW1 and the second reset switch SW2 are ON/OFF switches, and when the first reset switch SW1 is turned on, the first reset input RS1 is supplied to the first lockout releasing portion 2-2. When the second reset switch SW2 is turned on, the second reset input RS2 is supplied to the second lockout releasing portion 2-3. Immediately after the first reset switch SW1 and the second reset switch SW2 are turned on, the first reset switch SW1 and the second reset switch SW2 are returned to an off state. In addition, the first lockout releasing portion 2-2 and the second lockout releasing portion 2-3 transmit a release command to the lockout portion 2-1, to thereby release the lockout state of the combustion controlling device 2 (2A).

In addition, the first lockout releasing portion 2-2 receives the first reset input RS1 without any restriction to release the lockout state of the combustion controlling device 2 (2A). However, when the second lockout releasing portion 2-3 performs the release of the lockout state of the combustion controlling device 2 (2A) upon receiving the second reset input RS2 by a predetermined number of times (N) or more before a predetermined time (T) elapses after the second lockout releasing portion 2-3 receives the initial second reset input RS2 to release the lockout state of the combustion controlling device 2 (2A), the second lockout releasing portion 2-3 prohibits the release of the lockout state of the combustion controlling device 2 (2A) upon receiving the second reset input RS2 until the predetermined time (T) elapses. The function of the second lockout releasing portion 2-3 will be specifically described with reference to FIG. 2. In this example, the predetermined time T is set to 15 minutes and the predetermined number of times N is set to 5 times.

When the user turns on the second reset switch SW2 after the combustion controlling device 2 (2A) is put into lockout state (point t1 (first lockout)), the second reset input RS2 is transmitted to the second lockout releasing portion 2-3. The second lockout releasing portion 2-3 receives the transmitted second reset input RS2 as an initial second reset input RS2 and releases the lockout state of the combustion controlling device 2 (2A) (point t2 (first lockout release)). In this situation, the second lockout releasing portion 2-3 starts to count an elapsed time after the first lockout release as a timer time TM.

In this example, a second lockout is performed at a point t3 after the first lockout release has been performed (point t2), and a second lockout release is performed at a point t4. Also, after the second lockout release (t4) has been performed, a third lockout is performed at a point t5, and a third lockout release is performed at a point t6. Similarly, a fourth lockout is performed at a point t7, a fifth lockout is performed at a point t9, a fourth lockout release is performed at a point t8, and a fifth lockout release is performed at a point t10. Meanwhile, the timer time TM has not yet reached the predetermined time T=15 minutes.

Before the timer time TM reaches the predetermined time T=15 minutes, when the second lockout releasing portion 2-3 releases the lockout state of the combustion controlling device (2A) upon receiving the second reset input RS2 by N=5 times or more (point t10), the second lockout releasing portion 2-3 prohibits the release of the lockout state of the combustion controlling device 2 (2A) upon receiving the second reset input RS2 until the timer time TM reaches the predetermined time T=15 minutes.

For that reason, a time zone TB1 from a time when the first lockout release is performed until the number of lockout release reaches N=5 becomes a time zone (lockout release permission time zone) during which lockout release is permitted, and a time zone TB2 until the timer time TM reaches the predetermined time T=15 minutes after the number of times of lockout release becomes N=5 becomes a time zone (lockout release prohibition time zone) during which lockout release is prohibited. Even if the second reset input RS2 is input in the lockout release prohibition time zone TB2, the second lockout releasing portion 2-3 does not receive the second reset input RS2, and does not release the lockout state of the combustion controlling device 2 (2A).

Figure 2:
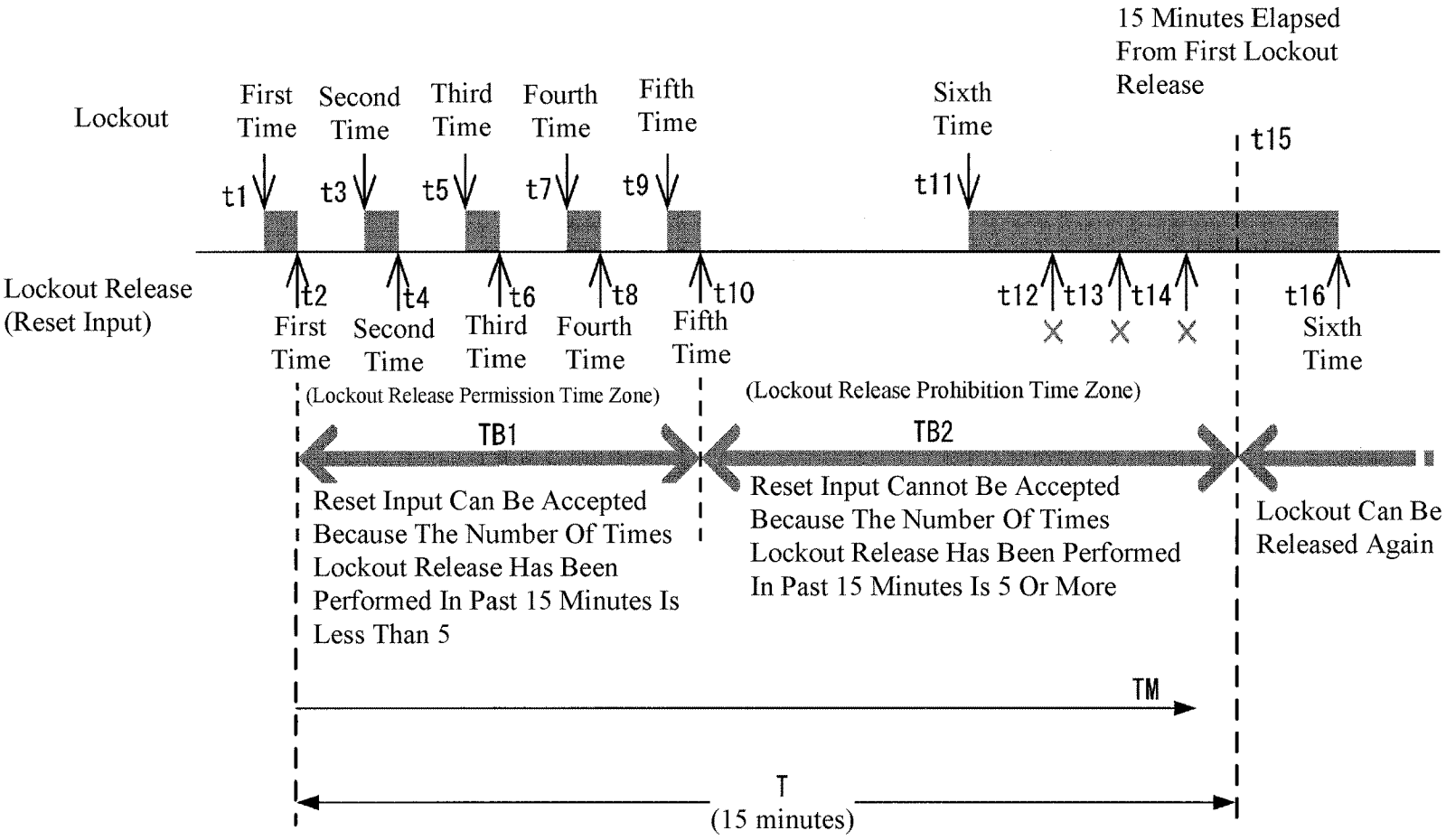
FIG. 2 is a diagram specifically illustrating a function of a second lockout releasing portion in the combustion controlling device.

In FIG. 2, a sixth lockout is performed at a point t11, and the reset operation is performed by the second reset switch SW 2 at points t12, t13, and t14. However, the second reset input RS2 input by the reset operation is not received and the lockout release is not performed. In this case, the lockout release can be again performed after the timer time TM has reached the predetermined time T=15 minutes, that is, after 15 minutes has elapsed from the first lockout release (point t15). In FIG. 2, a sixth lockout release is performed at a point t16 after 15 minutes have elapsed from the first lockout release.

As can be understood from the above description, in the present example, two types of reset switches are provided in the combustion controlling device 2 (2A), and the first reset switch SW1 is connected to the combustion controlling device 2 (2A) as a reset switch of a main body. The second reset switch SW 2 is installed as an external switch at a remote place distant from the combustion controlling device 2 (2A). No restriction is provided for the reset operation by the first reset switch SW1, and restrictions of the time (T) and the number of times (N) are provided for the reset operation by the second reset switch SW2.

As a result, when the first reset switch SW1 is operated, a service person or the like can release lockout while confirming the safety of the combustion device 19 in the vicinity of the combustion device 19. For that reason, a waiting time is small, the operation can be started immediately, and the combustion efficiency increases. Furthermore, since there is no restriction on the number of times of resetting, test operation is not interrupted (reset operation may be performed with the first reset switch SW1 at test operation).

Further, when the second reset switch SW2 is operated, the lockout can be released even from a remote place where the combustion device 19 cannot be seen. In this case, since the reset operation is restricted by the time (T) and the number of times (N), the combustion device 19 can be operated while ensuring safety. Also, until the predetermined time T=15 minutes elapses, the release of the lockout by the second reset switch SW2 is permitted with the limit of N=5 times. As a result, the frequent use of the second reset switch SW 2 from the remote place for a short time can be prevented.

In the above-described example, in order to inform that the lockout cannot be released by the second reset switch SW2 during the lockout release prohibition time zone TB2, for example, a red alarm lamp may be blinked.

Figure 3:
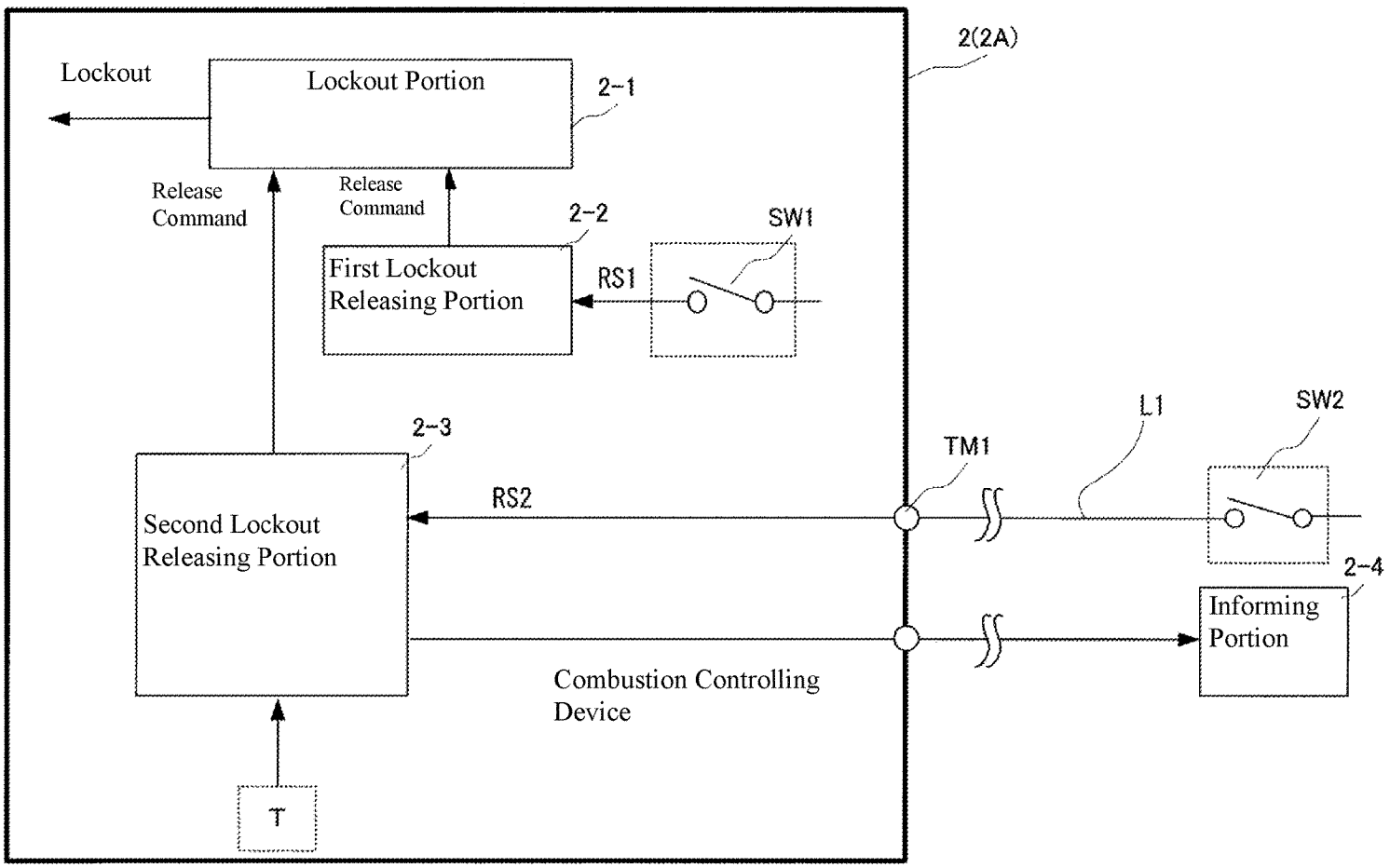
FIG. 3 is a diagram illustrating an example in which an informing portion for informing a lockout release prohibition time zone is installed in the vicinity of a second reset switch.

That is, as illustrated in FIG. 3, an informing portion 2-4 may be provided in the vicinity of the second reset switch SW2, and the red alarm lamp may be blinked in the informing portion 2-4 during the lockout release prohibition time zone TB2. In this case, even when the red alarm lamp is blinking, the release of the lockout by the first reset switch SW1 can be performed.

In addition, because a state becomes unsafe when resetting is kept due to a failure of the switch or the like, taking a case where reset cannot be automatically released due to the failure into consideration, a reset input self-diagnosis function may be provided for two circuits.

Figure 4:
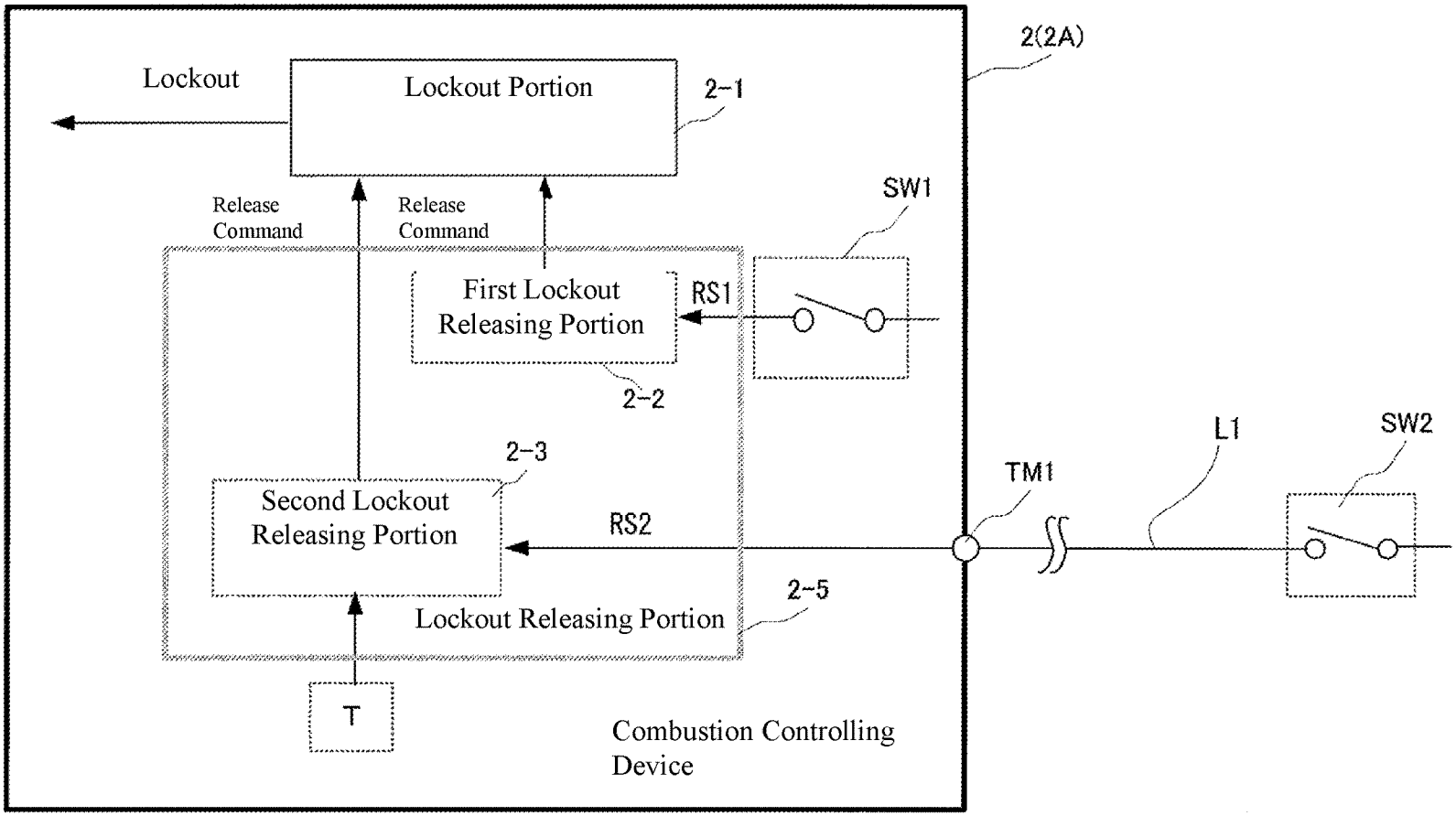
FIG. 4 is a diagram corresponding to FIG. 1 illustrating an example in which a first lockout releasing portion and the second lockout releasing portion are disposed in one lockout releasing portion.
Figure 5:
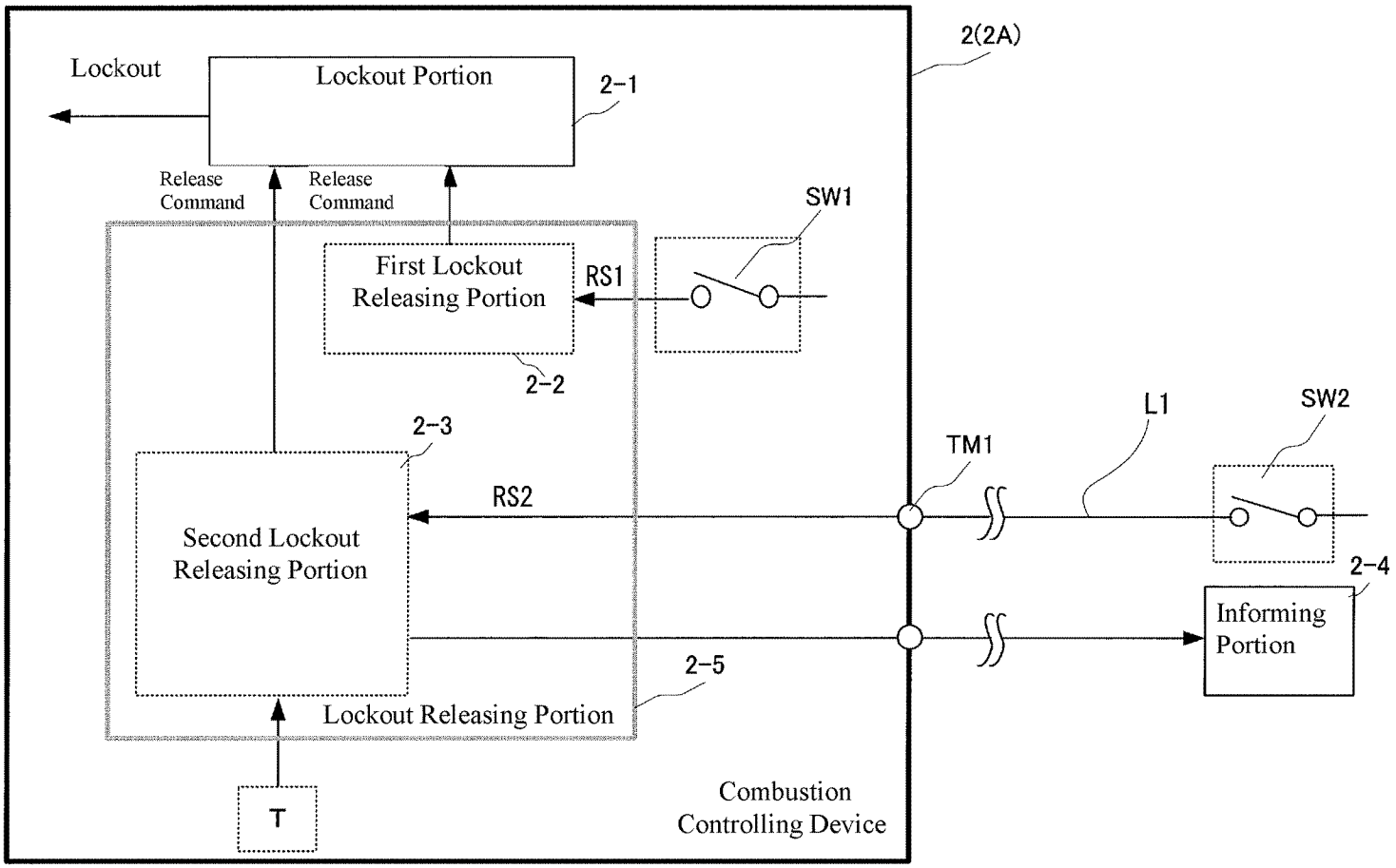
FIG. 5 is a diagram corresponding to FIG. 3 illustrating an example in which the first lockout releasing portion and the second lockout releasing portion are provided in one lockout releasing portion.

Also, in FIGS. 1 and 3, the first lockout releasing portion 2-2 and the second lockout releasing portion 2-3 may be provided independently, but as illustrated in FIGS. 4 and 5, the first lockout releasing portion 2-2 and the second lockout releasing portion 2-3 may be provided in one lockout releasing portion 2-5. That is, the lockout releasing portion 2-5 having a function of combining a function of the first lockout releasing portion 2-2 with a function of the second lockout releasing portion 2-3 may be provided.

Expansion of Example

Although the invention has been described with reference to the example above, the invention is not limited to the above example. Various changes understandable to those skilled in the art can be made to the structure and details of the invention within the scope of the invention.

What is claimed is:

1. A combustion controlling device for controlling an operation of a combustion device, comprising:

processing circuitry configured to monitor and detect an abnormality of the combustion device and output a control signal to the combustion device to stop the operation of the combustion device when the abnormality is detected and put the combustion controlling device into a lockout state; and a first reset switch attached to the combustion controlling device to manually issue a first reset input instructing restart of the operation of the combustion device, wherein the processing circuitry is further configured to receive, from a second reset switch connected to the combustion controlling device by a wire and provided at a remote place distant from the combustion controlling device, a second reset input instructing the restart of the operation of the combustion device;

receive the first reset input instructing the restart of the combustion device from the first reset switch without any restriction, and in response, release the lockout state of the combustion controlling device; and receive the second reset input instructing the restart of the combustion device from the second reset switch with a restriction, only releasing the lockout state of the combustion controlling device under predetermined conditions, wherein the processing circuitry is configured to release the lockout state of the combustion controlling device in response to receiving a particular second reset input, only when both a number of times of receiving the second reset input is less than a predetermined number of times and the particular second reset input is received before a predetermined time elapses starting from a time of receiving an initial second reset input, the number of times being counted starting from the time of receiving the initial second reset input, and otherwise prohibit the release of the lockout state in response to receiving the particular second reset input.

2. The combustion controlling device according to claim 1, wherein the processing circuitry is further configured to inform an operator that the release of the lockout state by the second reset switch cannot be performed, during a time when the release of the lockout state of the combustion controlling device, in response to receiving the second reset input, is prohibited.

3. The combustion controlling device of claim 1, wherein the processing circuitry is further configured to prohibit the release of the lockout state when the number of times of receiving the second reset input is equal to or greater than the predetermined number of times.

* * * * *